US010122091B2

(12) United States Patent
Lee et al.

(10) Patent No.: US 10,122,091 B2
(45) Date of Patent: Nov. 6, 2018

(54) MICROSTRIP PATCH ANTENNA IN CAVITY-BACKED STRUCTURE INCLUDING VIA-HOLE

(71) Applicants: Samsung Electronics Co., Ltd., Suwon-si (KR); Korea Electronics Technology Institute, Seongnam-si (KR)

(72) Inventors: Jae Sup Lee, Yongin-si (KR); Ho Jun Lee, Seongnam-si (KR); Se Hwan Choi, Seongnam-si (KR)

(73) Assignees: Samsung Electronics Co., Ltd., Suwon-si (KR); Korea Electronics Technology Institute, Seongnam-si (KR)

( * ) Notice: Subject to any disclaimer, the term of this patent is extended or adjusted under 35 U.S.C. 154(b) by 28 days.

(21) Appl. No.: 14/176,465

(22) Filed: Feb. 10, 2014

(65) Prior Publication Data

US 2015/0138035 A1 May 21, 2015

(30) Foreign Application Priority Data

Nov. 20, 2013 (KR) ..... 10-2013-0141459

(51) Int. Cl.
*H01Q 9/04* (2006.01)

(52) U.S. Cl.
CPC ..... *H01Q 9/0421* (2013.01); *H01Q 9/045* (2013.01)

(58) Field of Classification Search
CPC ..... H01Q 9/045; H01Q 9/0407; H01Q 9/0421
USPC ..... 343/700 MS
See application file for complete search history.

(56) References Cited

U.S. PATENT DOCUMENTS 4,063,246 A * 12/1977 Greiser ..... 343/700 MS
4,074,270 A * 2/1978 Kaloi ..... H01Q 1/521 343/700 MS
4,078,237 A * 3/1978 Kaloi ..... 343/700 MS
4,170,012 A * 10/1979 Kaloi ..... 343/700 MS
4,197,544 A * 4/1980 Kaloi ..... H01Q 1/48 343/700 MS
4,197,545 A * 4/1980 Favaloro et al. ..... 343/700 MS
4,477,813 A * 10/1984 Weiss ..... H01Q 21/065 343/700 MS
6,087,989 A 7/2000 Song et al.
6,885,343 B2 * 4/2005 Roper ..... H01Q 9/0407 343/700 MS (Continued)

FOREIGN PATENT DOCUMENTS

CN 201213154 Y 3/2009
KR 2001-0046037 A 6/2001

(Continued)

OTHER PUBLICATIONS

Waterhouse, R.B., "Small Printed Antenna Easily Integrated into a Mobile Handset Terminal", *Electronics Letters*, vol. 34, No. 17, Aug. 1998. pp. 1629-1631. (3 pages in English).

(Continued)

*Primary Examiner* — Robert Karacsony
(74) *Attorney, Agent, or Firm* — NSIP Law

(57) ABSTRACT

A microstrip patch antenna includes a via-hole pad including via-holes, a patch disposed on the via-hole pad, a feeding via-hole disposed at a side of the patch through the patch and the via-hole pad, and a shorting via-hole disposed at a side of the patch, and configured to connect the patch and a ground unit.

9 Claims, 4 Drawing Sheets

(56) References Cited

U.S. PATENT DOCUMENTS

| | | | | |
|---|---|---|---|---|
| 7,710,323 | B2 | 5/2010 | Boyanov et al. | |
| 2009/0322636 | A1* | 12/2009 | Brigham ..... | H01Q 13/106 343/770 |
| 2010/0245204 | A1 | 9/2010 | Lee et al. | |
| 2011/0063174 | A1 | 3/2011 | Cho et al. | |
| 2011/0241948 | A1 | 10/2011 | Bevelacqua et al. | |
| 2011/0241969 | A1 | 10/2011 | Zhang et al. | |
| 2012/0182066 | A1 | 7/2012 | Merkle et al. | |

FOREIGN PATENT DOCUMENTS

| | | | |
|---|---|---|---|
| KR | 10-0767543 | B1 | 10/2007 |
| KR | 10-0959823 | B1 | 5/2010 |

OTHER PUBLICATIONS

Chinese Office Action dated Jul. 4, 2018 in Chinese Patent Application No. 201410360050.0 (8 pages in English, 7 pages in Chinese).

* cited by examiner

MICROSTRIP PATCH ANTENNA IN CAVITY-BACKED STRUCTURE INCLUDING VIA-HOLE

CROSS-REFERENCE TO RELATED APPLICATION

This application claims the benefit under 35 USC 119(a) of Korean Patent Application No. 10-2013-0141459, filed on Nov. 20, 2013, in the Korean Intellectual Property Office, the entire disclosure of which is incorporated herein by reference for all purposes.

BACKGROUND

1. Field

The following description relates to a microstrip patch antenna in a cavity-backed structure including a via-hole.

2. Description of Related Art

A microstrip patch antenna is used for configuring an antenna on a common plane. Since the microstrip patch antenna has a half-wavelength, for example, a length of $\lambda/2$, reducing a size of the microstrip patch antenna may be difficult. When a ground unit of the microstrip patch antenna has a size similar to a size of a patch, an operational frequency transition may occur.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a microstrip patch antenna including a via-hole pad including via-holes, a patch disposed on the via-hole pad, a feeding via-hole disposed at a side of the patch through the patch and the via-hole pad, and a shorting via-hole disposed at a side of the patch, and configured to connect the patch and a ground unit.

The ground unit may be disposed at a distance from the patch that is less than or equal to a thickness of a substrate.

The via-hole pad may be disposed on a layer identical to that of the patch.

The microstrip patch antenna may further include a feed line connected to the patch via the feeding via-hole.

The patch may have a length less than a quarter of a wavelength in an operational frequency of the microstrip patch antenna.

In another general aspect, there is provided a microstrip patch antenna including a via-hole pad including via-holes, a patch disposed on the via-hole pad, and a ground unit disposed below the via-hole pad at a distance from the patch that is less than or equal to a thickness of a substrate on which the microstrip patch antenna is disposed.

The microstrip patch antenna may further include a shorting via-hole disposed at a side of the patch through the patch and the via-hole pad to the ground unit, and configured to connect the patch and the ground unit.

The microstrip patch antenna may further include a feeding via-hole disposed at a side of the patch through the patch and the via-hole pad to a feed line, and configured to feed from the feed line to the patch.

The via-holes may be disposed at a boundary of the microstrip patch antenna.

Other features and aspects will be apparent from the following detailed description, the drawings, and the claims.

Figure 1:
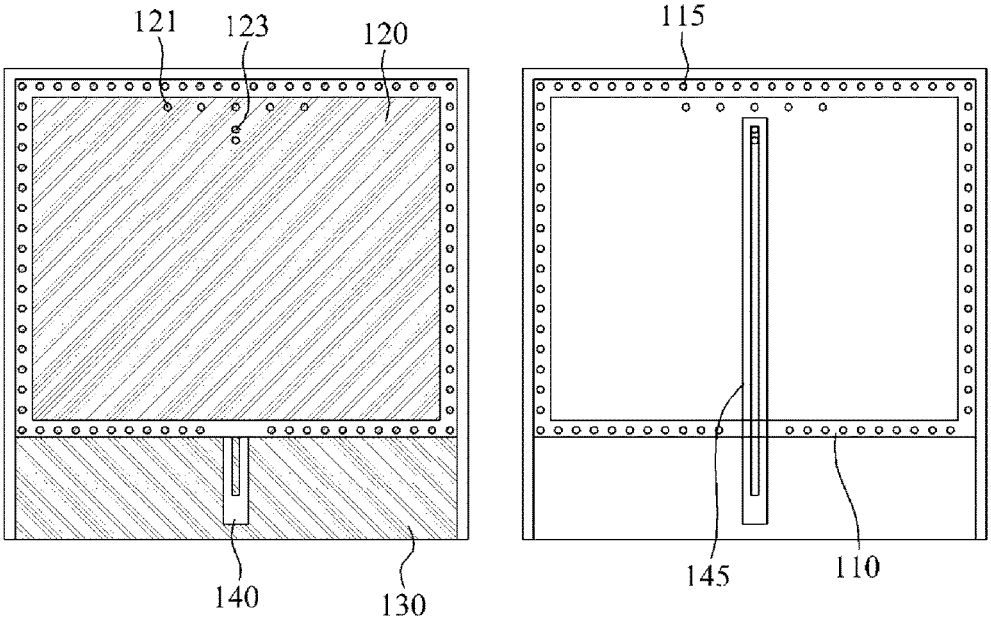
FIG. 1 is a diagram illustrating an example of a microstrip patch antenna including a cavity-backed structure.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" a second layer or a substrate is to be interpreted as covering both a case where the first layer is directly contacts the second layer or the substrate, and a case where one or more other layers are disposed between the first layer and the second layer or the substrate.

The spatially-relative expressions such as "below", "beneath", "lower", "above", "upper", and the like may be used to conveniently describe relationships of one device or elements with other devices or among elements. The spatially-relative expressions should be understood as encompassing the direction illustrated in the drawings, added with other directions of the device in use or operation. Further, the device may be oriented to other directions and accordingly, the interpretation of the spatially-relative expressions is based on the orientation.

FIG. 1 is a diagram illustrating an example of a microstrip patch antenna including a cavity-backed structure. Referring to FIG. 1, the microstrip patch antenna includes a via-hole pad 110, a patch 120, a shorting via-hole 121, a feeding via-hole 123, a ground unit 130, and a feed unit 140.

The via-hole pad 110 corresponds to the cavity-backed structure, and includes a plurality of via-holes including a via-hole 115 at a boundary of the microstrip patch antenna.

The patch 120 is disposed on the via-hole pad 110. A length of the patch 120 may be less than a quarter of a wavelength, for example, λ/4, in an operational frequency of the microstrip patch antenna.

Three types of via-holes are used in the microstrip patch antenna. The three types of the via-holes include the via-hole 115 of the cavity-backed structure at the boundary of the microstrip patch antenna, the shorting via-hole 121 to be used to connect the patch 120 disposed on an upper plane of the microstrip patch antenna and the ground unit 130 disposed on a lower plane of the microstrip patch antenna, and the feeding via-hole 123 to be used to feed from the feed unit 140 to the patch 120.

The shorting via-hole 121 is disposed at a side of the patch 120, and penetrates through the patch 120 and the via-hole pad 110 to the ground unit 130. The shorting via-hole 121 may be filled with metal to connect the patch 120 disposed on the upper plane of the microstrip patch antenna and the ground unit 130 disposed on the lower plane of the microstrip patch antenna. The shorting via-hole 121 may be provided in a single form or a plural form. The shorting via-hole 121 may be disposed at an upper portion of the patch 120 such that the length of the patch 120 is less than λ/4 in the operational frequency of the microstrip patch antenna.

The feeding via-hole 123 is disposed at a side of the patch 120, and penetrates through the patch 120 and the via-hole pad 110 to the feed unit 140. The feeding via-hole 123 may be filled with metal to feed from the feed unit 140 to the patch 120. The feeding via-hole 123 may be provided in a single form or a plural form.

The ground unit 130 may be disposed below the via-hole pad 110 at a distance from the patch 120 that is less than or equal to a thickness of a substrate on which the microstrip patch antenna is installed or disposed. That is, a gap between the patch 120 and the ground unit 130 may be less than or equal to the thickness of the substrate including the microstrip patch antenna, and thus, an energy field may be concentrated between the patch 120 and the ground unit 130 at an edge of the microstrip patch antenna. Various dielectric substances, for example, FR-4, Teflon, and/or a ceramic may be used as a material forming the substrate on which the microstrip patch antenna is installed or disposed.

The feed unit 140 feeds to the microstrip patch antenna, and includes a feed line 145 to be used to feed to the microstrip patch antenna. The feed line 145 may be, for example, a coplanar waveguide with ground plane (CPWG).

In this example, a size of the microstrip patch antenna is reduced using the via-holes, and adopts the cavity-backed structure around the microstrip patch antenna. Accordingly, a change in the operational frequency of the microstrip patch antenna that results from changes in a size of the ground unit 130 and a surrounding environment may be reduced, and degradation in emission efficiency of the microstrip patch antenna when compared to a conventional antenna may be reduced.

Figure 2:
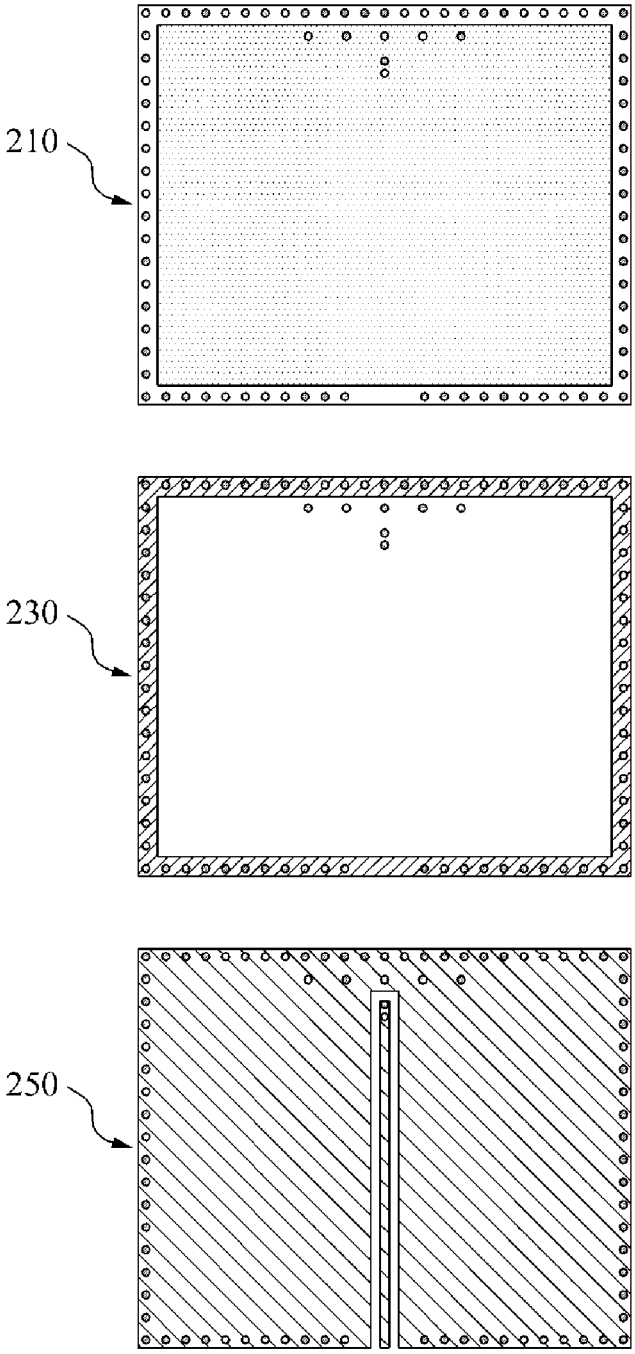
FIG. 2 is a diagram illustrating an example of a pattern for each layer of the microstrip patch antenna of FIG. 1.

FIG. 2 is a diagram illustrating an example of a pattern for each layer of the microstrip patch antenna of FIG. 1. Referring to FIG. 2, the microstrip patch antenna includes a first layer 210, a second layer 230, and a third layer 250. The microstrip patch antenna may include three layers or two layers.

The first layer 210 may correspond to a top plane, and includes a patch (e.g., 120 of FIG. 1) configuring the microstrip patch antenna.

The second layer 230 may correspond to an intermediate plane, and may include a metal pattern disposed at a boundary of the second layer 230. The metal pattern may be disposed at a distance less than a substrate height (thickness) h, from a surface of the patch and to a boundary of a substrate.

The second layer 230 may include a via-hole pad (e.g., 110 of FIG. 1) including a plurality of via-holes (e.g., the via-hole 115 of FIG. 1) disposed at the boundary of the second layer 230. The via-hole pad may be configured without the second layer 230, and may be disposed on the first layer 210 when the second layer 230 is absent.

The third layer 250 includes a feed line (e.g., 145 of FIG. 1), for example, a CPWG line, and a ground unit (e.g., 130 of FIG. 1). The third layer 250 may correspond to a bottom plane.

The feed line is extended from a boundary of the microstrip patch antenna to a vicinity of a feeding via-hole (e.g., 123 of FIG. 1) so as to be connected to the patch of the first layer 210 and to feed to the microstrip patch antenna. In an example, the microstrip patch antenna may be directly fed using a connector, and the feed line 145 may be unnecessary in this example.

Figure 3:
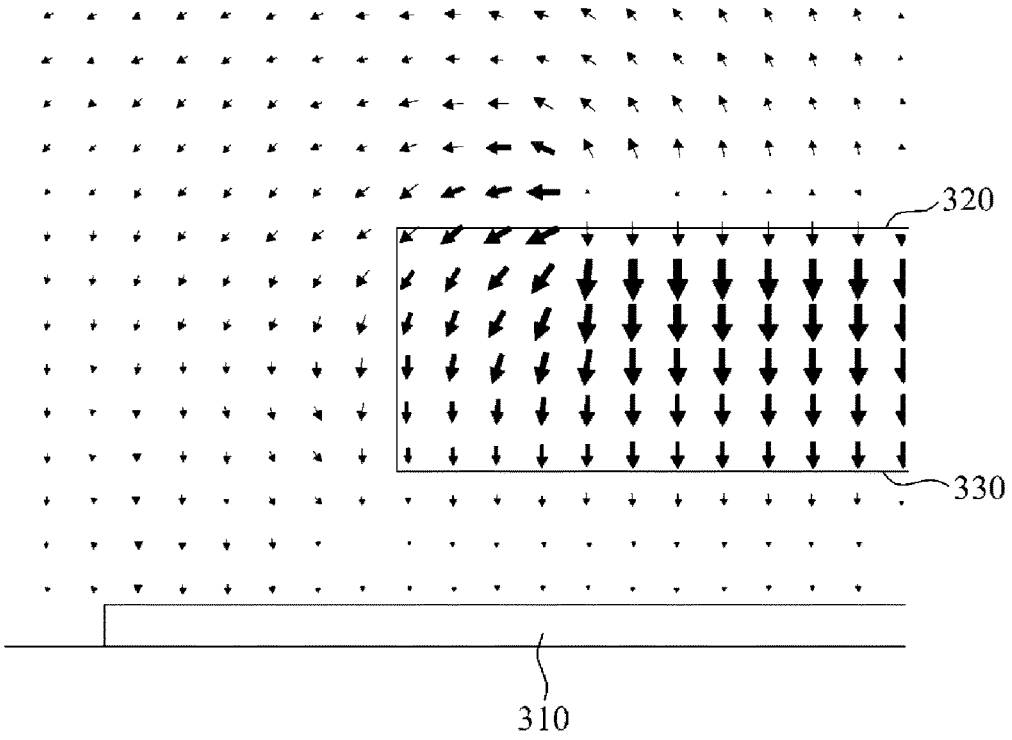
FIG. 3 is a diagram illustrating an example of electric field distribution in a microstrip patch antenna including a non-cavity-backed structure.

FIG. 3 is a diagram illustrating an example of electric field distribution in a microstrip patch antenna including a non-cavity-backed structure. Referring to FIG. 3, in the conventional microstrip patch antenna including the non-cavity-backed structure, an electric field may be distributed among a patch 320 in an upper portion of the microstrip patch antenna, a ground unit 330 on an antenna substrate, and a test board 310 disposed below the ground unit 330. A fringing field occurs between the patch 320 and the ground unit 330.

In detail, when a patch antenna is designed, a desired frequency may be emitted using a patch having a length less than λ/2 due to a length increment caused by a leakage electric field. In the example of FIG. 3, an electric field of the patch 320 is uniform widthwise. Lengthwise, a frequency may fluctuate when the strongest electric field is satisfied on ends of both sides of the microstrip patch antenna. Thus, a fringing effect may be considered with respect to a lengthwise boundary. The fringing field may indicate an electric field distributed in a boundary of an antenna element, and may contribute to radiation of energy. In an operational frequency of the microstrip patch antenna, each phase of fields on the ends of both sides of the microstrip patch antenna may become identical, and the fringing field may be merged, thereby radiating an electromagnetic wave.

Figure 4:
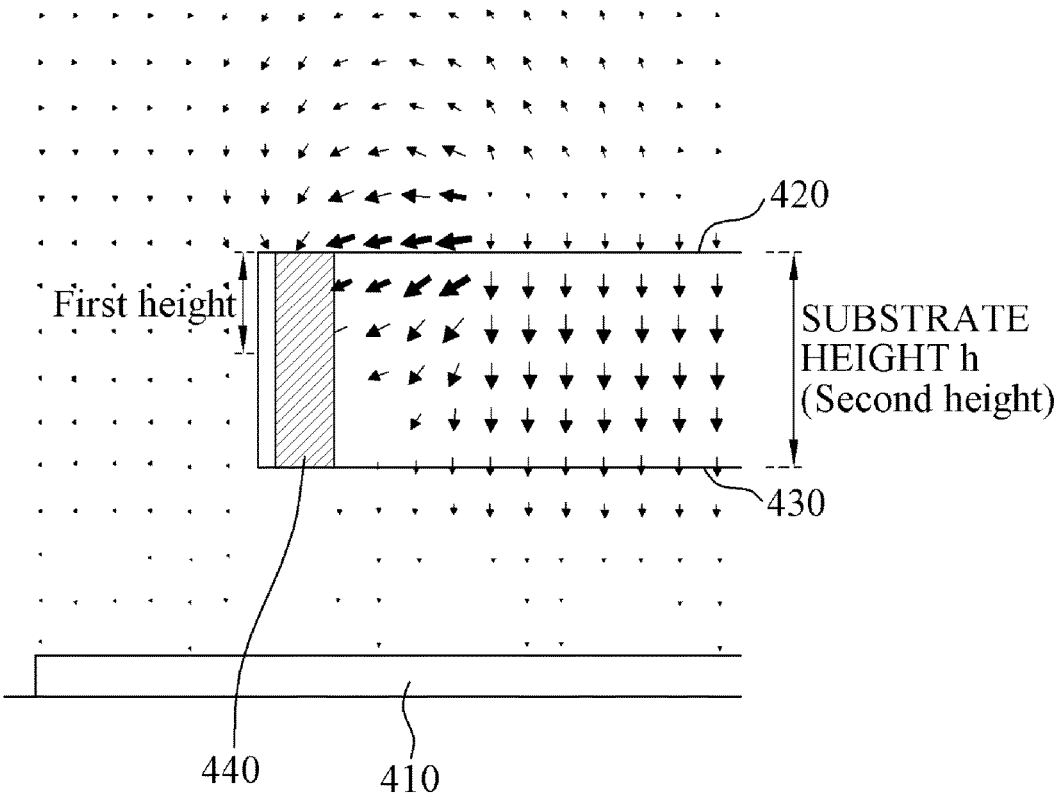
FIG. 4 is a diagram illustrating an example of electric field distribution in a microstrip patch antenna including a cavity-backed structure.

FIG. 4 is a diagram illustrating an example of electric field distribution in a microstrip patch antenna including a cavity-backed structure. Referring to FIG. 4, in the microstrip patch antenna, a ground unit 430 is disposed at a distance less than a substrate height (thickness), for example, h, from a surface of a patch 420.

In this example, it may be difficult for a fringing field to occur with a main substrate including a test board 410 disposed below a ground unit 430, and formed with the ground unit 430 disposed below and connected to the patch 420, using a shorting via-hole 440, as discussed above. Thus, dielectric loss caused by a dielectric occurring on a back side of the antenna may be reduced.

In general, characteristics of an antenna may vary based on a size and a shape of a ground. In this example, the antenna may not be significantly influenced by conditions of the ground since the antenna is designed to prevent the ground unit 430 from an influence of the electric field. Also, in an example, a shorted patch antenna may be configured using a shorting pin, thereby reducing a length of a patch by λ/7.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A microstrip patch antenna comprising:

a via-hole pad comprising a metal pattern defined at an outer boundary of the via-hole pad;

a patch disposed on the via-hole pad; and a ground unit disposed below the via-hole pad at a first height from the patch, a substrate having a second height disposed between the patch and the ground unit, wherein the first height is less than the second height, wherein the metal pattern, the patch and the ground unit comprise via-holes that are aligned, wherein the patch has a length less than a 1/7 of a wavelength in an operational frequency of the microstrip patch antenna using a shorting pin, and wherein an energy field is concentrated between the patch and the ground unit in an edge of the microstrip patch antenna.

2. The microstrip patch antenna of claim 1, further comprising:

a shorting via-hole disposed at a side of the patch through the patch and the via-hole pad to the ground unit, and configured to connect the patch and the ground unit.

3. The microstrip patch antenna of claim 1, further comprising:

a feeding via-hole disposed at a side of the patch through the patch and the via-hole pad to a feed line, and configured to feed from the feed line to the patch.

4. The microstrip patch antenna of claim 1, wherein the via-hole pad and the patch each has a substantially rectangular contour.

5. A microstrip patch antenna comprising:

a via-hole pad corresponding to a cavity-backed structure, the via-hole pad comprising a metal pattern defined in an outer boundary of the via-hole pad;

a patch disposed on the via-hole pad;

a shorting via-hole configured to connect the patch and a ground unit;

a feeding via-hole configured to feed a feed unit to the patch, the feeding via-hole disposed at a side of the patch and penetrating through the patch and the via-hole pad to the feed unit, wherein the ground unit is disposed at a first height from the patch, a substrate having a thickness defining a second height is disposed between the patch and the ground unit, and the first height is less than the second height, wherein the metal pattern, the patch and the ground unit comprise via-holes that are aligned, wherein the patch has a length less than a 1/7 of a wavelength in an operational frequency of the microstrip patch antenna using a shorting pin, and wherein an energy field is concentrated between the patch and the ground unit in an edge of the microstrip patch antenna.

6. A microstrip patch antenna, comprising:

a first layer comprising a patch;

a second layer comprising a via-hole pad and a metal pattern disposed at an outer boundary of the via-hole pad;

a third layer comprising a feed line and a ground unit, wherein the first layer, the second layer and the third layer are on different planes;

a feeding via-hole disposed at a side of the patch through the patch and the via-hole pad; and a shorting via-hole disposed at a side of the patch, and configured to connect the patch and the ground unit, wherein the second layer is disposed between the first layer and the third layer, and the feed line extends from a boundary of the microstrip patch antenna to connect with the patch, wherein the metal pattern, the patch and the ground unit comprise via-holes that are aligned, wherein the patch has a length less than a 1/7 of a wavelength in an operational frequency of the microstrip patch antenna using a shorting pin, and wherein an energy field is concentrated between the patch and the ground unit in an edge of the microstrip patch antenna.

7. The microstrip patch antenna of claim 6, wherein the feed line connects to the patch via the feeding via-hole.

8. The microstrip patch antenna of claim 6, wherein the feed line extends from a boundary of the microstrip patch antenna proximate to the feeding via-hole.

9. The microstrip patch antenna of claim 6, wherein the ground unit is disposed below the patch at a distance defining a first height that is equal to a second height defined by a thickness of a substrate on which the microstrip patch antenna is disposed.

* * * * *